United States Patent [19]

Frost

[11] 4,445,495

[45] May 1, 1984

[54] PORTABLE STOVE WITH GIMBAL MOUNTING

[75] Inventor: John W. Frost, DePere, Wis.

[73] Assignee: Jax Products Inc., DePere, Wis.

[21] Appl. No.: 439,055

[22] Filed: Dec. 22, 1982

[51] Int. Cl.[3] ..... F24C 15/30

[52] U.S. Cl. ..... 126/24; 126/39 R; 248/311.2; 431/343; 114/191; 211/81

[58] Field of Search ..... 126/24, 39 R, 39 L, 126/40, 38; 431/343; 248/311.2; 211/81; 114/188, 191

[56] References Cited

U.S. PATENT DOCUMENTS

| | | | |
|---|---|---|---|
| 1,421,890 | 7/1922 | Baker | 126/24 |
| 2,099,838 | 11/1937 | Carlson | 114/191 |
| 2,379,206 | 6/1945 | Westlake | 126/24 |
| 2,394,677 | 2/1946 | Fortis | 431/343 |
| 2,520,412 | 8/1950 | Jensen | 114/191 |
| 2,693,176 | 11/1954 | Spiers et al. | 126/24 |
| 4,093,166 | 6/1978 | Iida | 248/311.2 |
| 4,098,483 | 7/1978 | Pesola et al. | 248/311.2 |
| 4,131,259 | 12/1978 | Franks | 248/311.2 |

*Primary Examiner*—James C. Yeung
*Attorney, Agent, or Firm*—James E. Nilles

[57] ABSTRACT

A marine stove comprises a valve body for coaxial connection to a nipple on a pressure gas bottle, a tubular mixer coaxially telescopingly threaded into the top of the valve body, a burner above the mixer that is coaxially supported by it, and a grill over the burner, also supported by the mixer. A pivot confined between the valve body and the mixer has opposite laterally projecting coaxial trunnions that define one gimbal axis for the stove. Another gimbal axis is defined by a shaft that has a head at a rear end thereof and a U-shaped yoke at its front with forwardly projecting legs that have upwardly opening grooves wherein the trunnions are received. A mounting plate securable in forwardly offset relation to a bulkhead has a shaft hole through which the head is received. The shaft is rotatably supported in forwardly projecting relation to the plate by a bracket that hooks into the plate and has upwardly projecting abutments between which the shaft is closely received.

6 Claims, 8 Drawing Figures

PORTABLE STOVE WITH GIMBAL MOUNTING

FIELD OF THE INVENTION

This invention relates to portable stoves of the type that receive fuel from a pressurized bottle having an outlet nipple at its top, and the invention is more particularly concerned with a small stove that is especially suitable for marine use because it is gimballed to swing about mutually perpendicular horizontal axes to remain upright notwithstanding substantial tilting of a bulkhead or other structural member to which it is attached.

BACKGROUND OF THE PRIOR ART

A number of small marine stoves are commercially available, many of them gimbal mounted to remain upright during pitching and rolling of a boat. A primary consideration with any such stove is safety, not only from the obvious standpoint of minimizing potential fire hazards but also from the standpoint of minimizing the possibility of persons near the stove burning themselves by contact with hot parts of it and of spillage of material being heated by the stove. It is also desirable that such a stove provide for reasonably fast heating, and to that end its fuel source is preferably bottled gas and the burner of the stove has provision for detachable connection with the small bottles in which pressurized fuel gas is commercially supplied.

Most of the stoves of this type that are now available have a pair of upright arms or similar structure projecting a substantial distance above the burner for swingable connection with a yoke which in turn rocks about a transverse axis to comprise a part of a gimbal support for the stove. The yoke is substantially Y-shaped, with a short stem portion which provides for its rockable support and which is readily removably receivable in a fitting that may be permanently mounted on a bulkhead or other structural member. The upwardly projecting portions of the stove that connect with the yoke impose stringent limitations upon the maximum diameter of cooking vessels that can be used with the stove, and they tend to interfere with access to a cooking vessel resting on the stove. Unless the cooking vessel has a laterally projecting handle (which can present problems in a rough sea) its removal from the stove may require adroit manipulation.

From a structural standpoint, such conventional gimbal mounting arrangements leave much to be desired. The forwardly divergent arms of the yoke have to be rather sturdy and bulky to support the stove plus a vessel and its contents, and they concentrate highly leveraged forces upon the short rearwardly projecting stem portion of the yoke and the fitting in which that stem portion pivots.

Although these disadvantages of heretofore conventional gimbal mountings for small stoves have been clearly evident, the problem of devising a better arrangement has not been easy to solve. An important consideration is that the fitting that carries the gimbal structure can be permanently mounted on a bulkhead or the like but should accommodate quick and easy removal of the gimbal structure, and with the stove and gimbals removed the fitting should protrude as little as possible from the structural member to which it is attached. When taken down, the gimbal structure should itself be very compact, to occupy a minimum of stowage space. It will be apparent that the center of gravity of the system comprising the stove itself, a vessel on the stove and contents of the vessel must be spaced as far as possible beneath the gimbal pivot axes, to ensure that the stove will maintain an upright attitude in a rough sea.

SUMMARY OF THE INVENTION

The general object of the present invention is to provide a small gimbal mounted stove that is particularly suitable for marine use, having all of the desirable features mentioned above and none of the undesirable ones.

More specifically, it is an object of this invention to provide a gimbal mounting for a small stove of the character described, comprising a very compact mounting member which can be permanently secured to a bulkhead or the like and which protrudes only a very small distance from the bulkhead, and which cooperates with a few very simple, sturdy and compact parts that can be quickly and easily assembled and disassembled to provide a gimbal structure wherein stresses and strains are well distributed and whereby the stove proper is supported from beneath its burner so that the space above the burner is clear and accessible from all directions.

Another and more specific object of the invention is to provide a gimballed stove of the character described that has its center of gravity well below the gimbal pivot axes, even when a cooking vessel and its contents are supported on the stove, and even though those pivot axes are below the burner.

It is also an object of the invention to provide a small stove and gimbal mounting therefor that is inexpensive although unusually sturdy, compact, safe and convenient.

In general, these and other objects of the invention that will appear as the description proceeds are achieved in a portable stove of the type that comprises a burner, connection means for communicating the burner with an outlet nipple at an upper end of a pressurized fuel container, and means for supporting a cooking vessel above the burner to be heated thereby. The stove of this invention is characterized in that the connection means for communicating said burner with said nipple comprises a pair of coaxial elements, one of which has a portion that is threaded into the other, said elements having axially opposed circumferential shoulders surrounding said threaded portion; a pivot member having a flat body wherein there is a hole through which said threaded portion extends and which is confined between said shoulders, and a pair of coaxial trunnions projecting from said body in opposite edgewise directions. A shaft has at a front end thereof a substantially U-shaped yoke with forwardly projecting legs that can straddle said telescoping elements and in each of which there is an upwardly opening groove wherein one of said trunnions is receivable to connect said telescoping elements with the shaft for swinging about an axis transverse to that of the shaft; and the shaft is in turn supported for rotation about its axis by mounting means that maintain its axis horizontal. The mounting means preferably comprises a plate having front and rear surfaces and having a shaft receiving hole and a plurality of vertically elongated hook apertures; attachment means for securing the plate to a structural member with said rear surface in forwardly spaced relation to an upright surface on the structural member; a head on the rear end of the shaft that is receivable through said hole in the plate and is engageable with said rear surface to releasably confine the shaft against axially forward movement; and a bracket cooperable with edge portions of the plate that are defined by said hole therein to support the shaft in forwardly projecting rotatable relation to the plate, said bracket having a top surface upon which the shaft rests, opposing abutments projecting above said top surface and between which the shaft is closely receivable, and a plurality of rearwardly and downwardly projecting hooks which are receivable in said apertures to detachably connect the bracket with the plate. To maintain the center of gravity of the stove well below the transverse horizontal axes of the shaft and the trunnions, a weight is detachably secured to a pressurized fuel container connected with the burner, and preferably the weight comprises a magnet so as to be magnetically securable to the fuel container.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
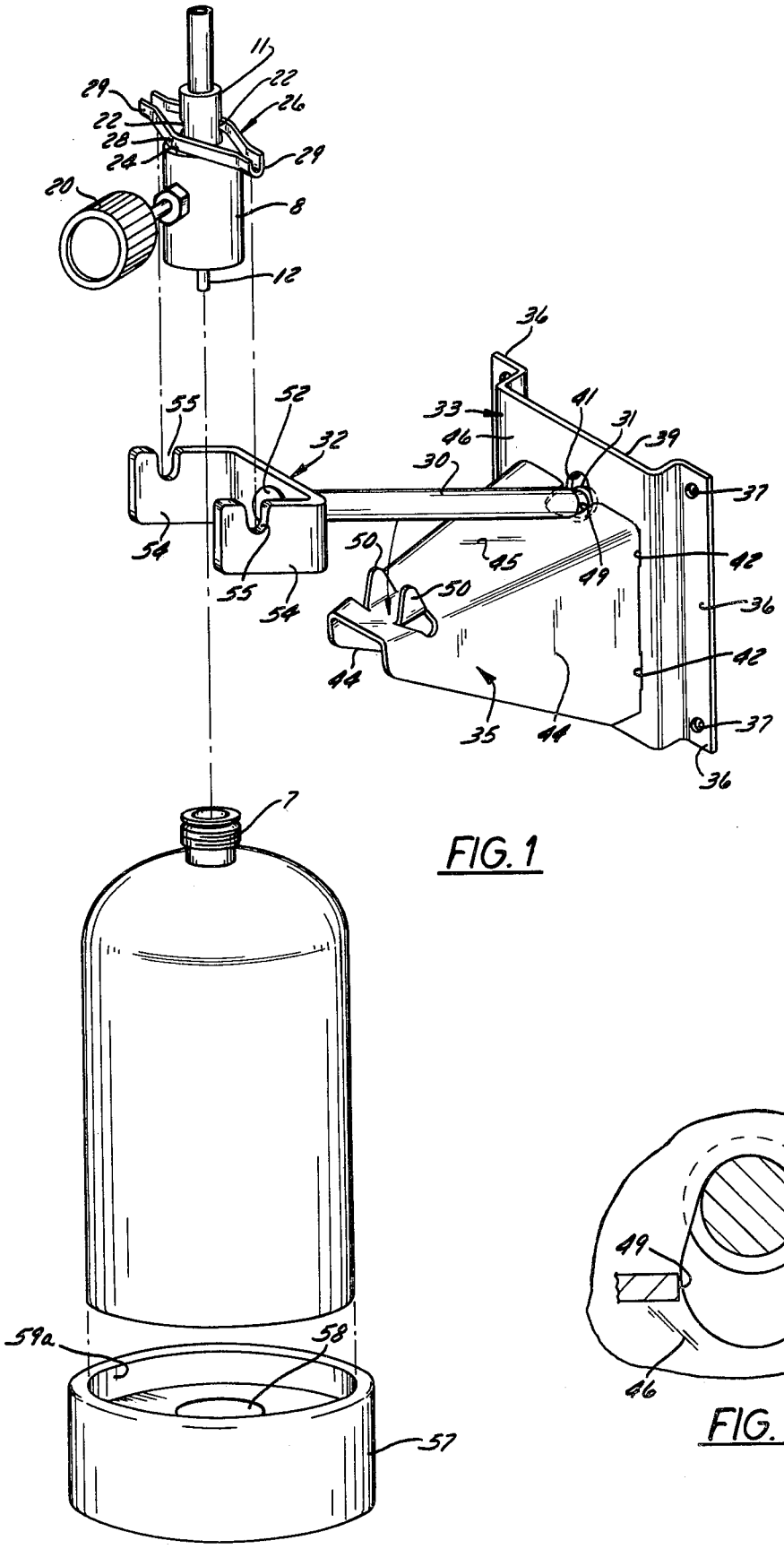
FIG. 1 is a partially disassembled perspective view of a portable stove gimbal mounting of this invention and the portion of the stove with which it is directly associated.
Figure 2:
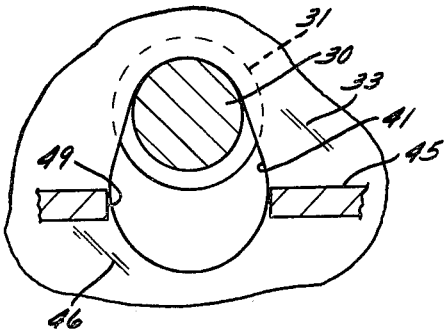
FIG. 2 is a fragmentary detail view in cross section through the shaft at its connection with the mounting plate.
Figure 3:
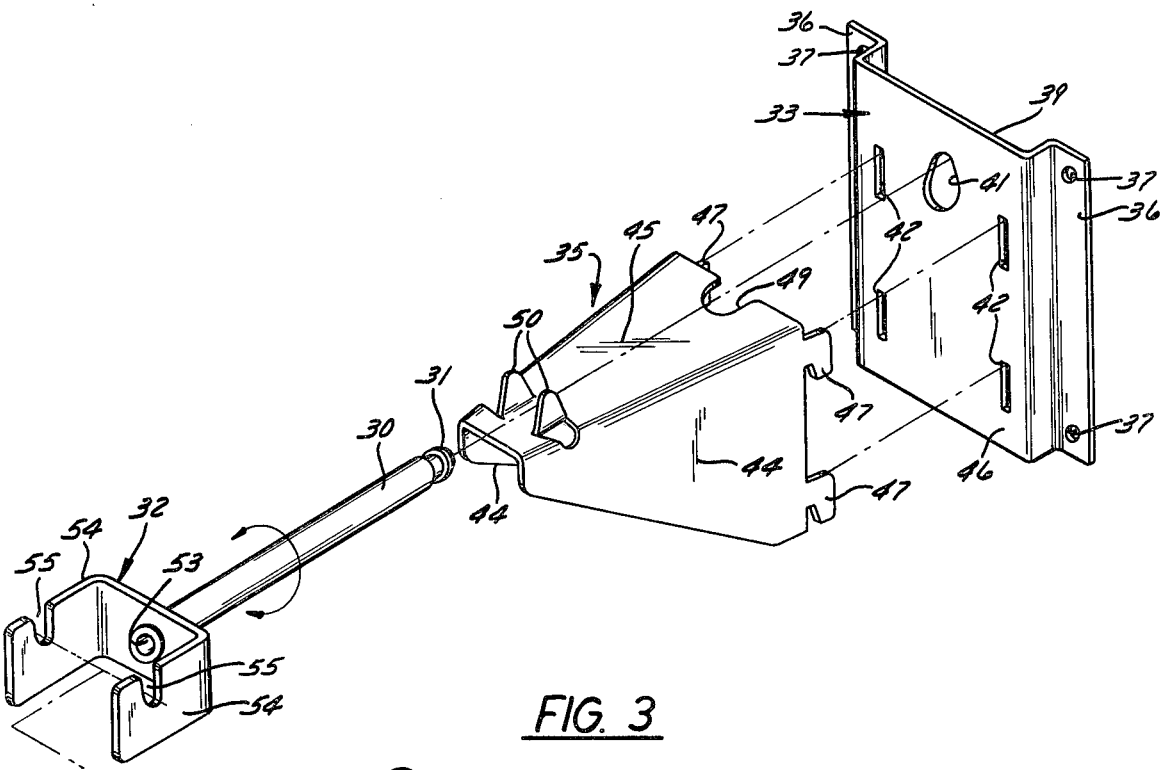
FIG. 3 is a disassembled perspective view of the gimbal mounting in relation to the valve body and mixer of the stove.
Figure 4:
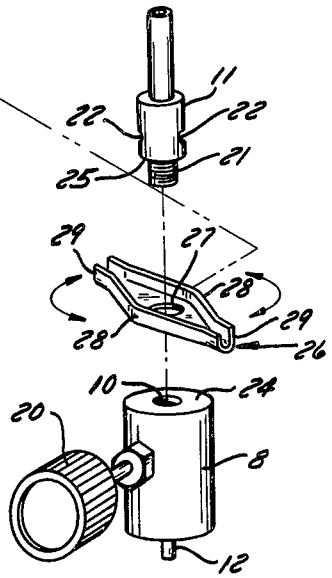
FIG. 4 is a view in vertical section through the stove itself.
Figure 4:
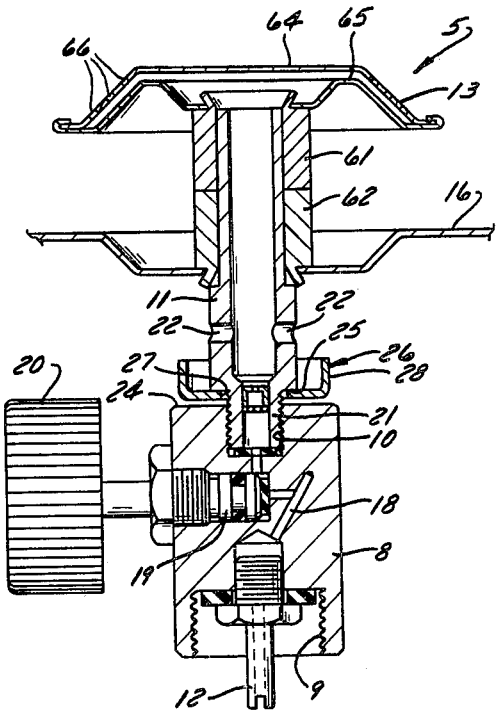
Figure 5:
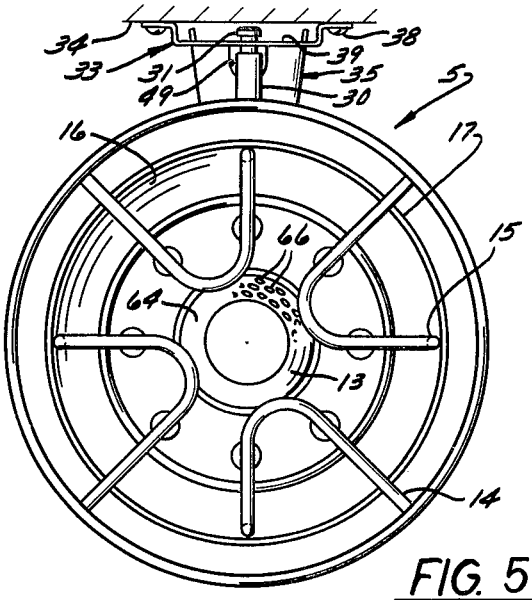
FIG. 5 is a top view of the stove and its gimbal mounting.
Figure 7:
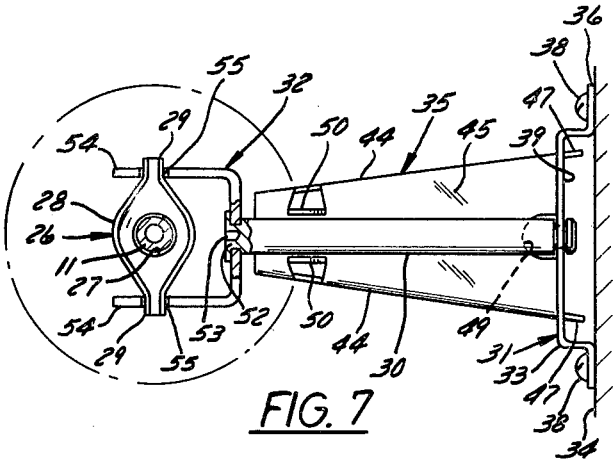
FIG. 7 is a view taken substantially on the plane of the line 7—7 in FIG. 6.

A portable stove 5 that embodies the principles of this invention is intended for detachable connection to a pressure bottle 6 of a commercially available type, which, as sold, is charged with pressurized fuel such as propane gas and is intended to be discarded when empty. Conventionally, such a bottle is generally cylindrical, with a length substantially greater than its diameter, and it has a threaded coaxial nipple fitting 7 at its top to provide for its connection to a consuming device. As is well known (and is therefore not shown), the outlet to the nipple fitting 7 is normally closed by an upwardly biased valve element in the bottle 6 that is pushed down off of its seat in consequence of connection of a consuming device to the nipple fitting 7.

The stove 5 of this invention comprises a valve body 8 that has a coaxial internally threaded lower port 9 in which a pressure bottle nipple fitting 7 is received and a coaxial internally threaded upper port 10 into which a mixer 11 is threaded. The valve body 8 also has a probe 12 that projects coaxially downwardly in its lower port 9 and depresses the valve in the pressure bottle 6 as the connection with its nipple 7 is established, to allow fuel to flow upwardly from the pressure bottle through the valve body 8 and the mixer 11 to a burner 13 that is coaxially connected to the top of the mixer.

Over the burner 13 there is a grill 14 upon which a cooking vessel (not shown) can rest to be heated by a flame at the burner. The grill 14 has downwardly projecting legs 15 that are supported by a pan 16 which is coaxially connected with the mixer and underlies the burner 13. An upwardly projecting circumferential flange 17 on the pan 16 closely surrounds the legs 15 of the grill 14 to maintain the grill concentric to the burner 13.

The valve body 8 is bored to define a passage 18 that extends through it from its lower port 9 to its upper port 10. The rate of flow of fuel gas through the passage 18 is controlled by a manually adjustable valve 19 which has its rotatable adjusting knob 20 at one side of the valve body.

The mixer 11 is an elongated tubular member having a concentric reduced diameter lower end portion 21 which is threaded into the coaxial upper port 10 in the valve body 8. The mixer 11 also has a reduced diameter coaxial upper portion that is surrounded by upper and lower bushings 61 and 62, respectively. The pan 16 that supports the grill 14 is concentrically staked to the bottom of the lower bushing 62. To the top of the upper bushing 61 is staked the burner 13, which comprises upper and lower pans 64 and 65, respectively, that are connected at their rims. In the upper pan 64 there are a plurality of small holes 66 through which fuel-air mixture issues for combustion. The largest diameter portion of the mixer 11 has one or more laterally opening ports 22 through which combustion air is drawn into the upwardly flowing stream of fuel gas. The bushings 61 and 62 slide axially onto the reduced diameter upper portion of the mixer and rest on the upwardly facing shoulder defined by its largest diameter intermediate portion; hence the stove can be quickly and easily assembled and disassembled. The bushings 61, 62 can be interchangeable with similar bushings that comprise a lantern assembly to be fueled from the pressure bottle 6 (as disclosed in my copending U.S. patent application Ser. No. 386,949, filed June 10, 1982), and the lantern to which the stove is in effect converted will be advantageously maintained in a straight-up orientation by the structure herein described.

The top of the valve body 8 and the largest diameter portion of the mixer 11 define axially opposing circumferential shoulders 24 and 25, respectively, which surround the connection between those parts. Confined between those shoulders 24 and 25 is the flat, somewhat elongated body of a pivot 26, wherein there is a hole 27 through which the lower reduced diameter portion 21 of the mixer extends. The pivot 26 can be suitably stamped from sheet metal, and its longitudinal edge portions are bent up to provide stiffening flanges 28 that are continuous with coaxial trunnions 29 at its opposite ends. The pivot 26 provides for readily detachable connection of the stove 5 with gimbal structure comprising the elements best seen in FIG. 1, and the trunnions 29 provide for swinging of the stove about one of a pair of horizontal gimbal axes that are perpendicular to one another and to the axis of the mixer 11.

In general, the gimbal structure comprises a shaft 30 that has a head 31 at a rear end thereof and a substantially U-shaped yoke 32 at its front end that is engaged by the trunnions 29, a mounting plate 33 that is securable to a bulkhead 34 or similar structural member, and a bracket 35 which is detachably securable to the mounting plate 33 and which cooperates with the mounting plate to rotatably support the shaft 30 in a horizontally extending orientation. As the description proceeds, it will be seen that the axis of the shaft 30 is the other one of the two horizontal axes about which the stove 5 is swingable.

The mounting plate 33, which can be made as a unitary rectangular sheet metal stamping, has a rearwardly offset flange 36 extending along each of its longitudinal edges. Each flange 36 has holes 37 for receiving screws 38 by which the mounting plate is secured to a structural member 34 with a rear surface 39 of the plate in forwardly spaced relation to an upright surface of that member. When the stove 5 and its gimbal mounting are taken down, only the very compact mounting plate 33 remains in place, and it protrudes only negligibly from the structural member 34.

The mounting plate 33 has one hole 41 for the shaft 30, located in its upper central portion, and it has a plurality of vertically elongated hook receiving apertures 42 that provide for secure but readily detachable connection of the bracket 35 to the mounting plate.

The bracket 35, like the mounting plate, can be made of sheet metal as a unitary stamping. As viewed from its front or from its rear, the bracket 35 has an inverted U-shaped or channel-shaped cross section, with flange-like legs 44 that project downwardly from a flat web 45. The rear edges of the web 45 and the legs or flanges 44 are for the most part coplanar, to engae against a flat front surface 46 of the mounting plate 33, but on each leg 44 of the bracket there are a pair of vertically spaced hooks 47 that extend beyond the rear edge of the leg and project downwardly. These hooks 47 can be inserted through the hook apertures 42 in the mounting plate 33 to engage that plate and readily detachably connect the bracket 35 to it. It will be evident that a very stable connection of the bracket 35 to the mounting plate 33 is maintained by gravity, and that the bracket 35 can be quickly removed by simply lifting it slightly and moving it forwardly away from the mounting plate.

The shaft 30 normally overlies the flat top surface of the bracket 35 and extends through the hole 41 in the mounting plate 33 to have its head 31 engaged with the rear surface 39 of the mounting plate, while the yoke 32 is spaced a short distance forwardly beyond the front end of the bracket. The shaft receiving hole 41 in the mounting plate is preferably oval, with a bottom portion that is wider than its top portion. The head 31 on the rear end of the shaft can pass through only the wider bottom portion of the shaft hole 41. Although a part of the bottom edge of the hole 41 is below the level of the web 45 of the bracket, the rear edge of the web 45 has a bay or cutout 49 which is just in front of the shaft hole 41 and is as wide as the widest portion of that hole; and therefore the head 31 can readily pass through the hole 41 if the shaft is tilted to have its front end higher than the head 31. When the shaft 30 is in its horizontal normal position, engaging the top surface of the web 45 along its length, the shaft extends through the narrower upper portion of the shaft hole 41, which fits it closely, and the shaft is confined against axial forward displacement by the engagement of its head 31 against the rear surface 39 of the mounting plate around the edge of the shaft hole 41. Cooperating with the shaft hole 41 to confine the shaft 30 against lateral motion are a pair of lugs 50 on the bracket which are struck upward from its web portion 45 near the front end thereof and which provide opposing abutments between which the shaft is closely received. Removal of the shaft requires only that its front end be tipped up and that its head 31 be axially withdrawn from the hole 41.

The yoke 32 can comprise a simple U-shaped member having a hole through its bight portion through which a short reduced diameter front end portion 52 of the shaft 30 extends. A coaxial well 53 in the front end portion of the shaft enables the endmost portion of the shaft to be peened over for sturdy securement of the yoke 32 to the shaft.

The yoke 32 normally maintains a position in which its forwardly projecting legs 54 are spaced horizontally to opposite sides of the axis of the shaft 30. In each leg 54 of the yoke 32 there is a transverse upwardly opening groove 55 that has a rounded bottom, and the trunnions 29 on the pivot 26 are received in these grooves 55. The rounded bottoms of the trunnions 29 pivotably engage the rounded bottoms of the grooves 55 to provide for swinging of the stove about the gimbal axis defined by the trunnions. It will be observed that the connection of the pivot 26 to the yoke 32, like the other detachable connections hereinabove described, is maintained by gravity but is nevertheless a stable and secure one.

Figure 8:
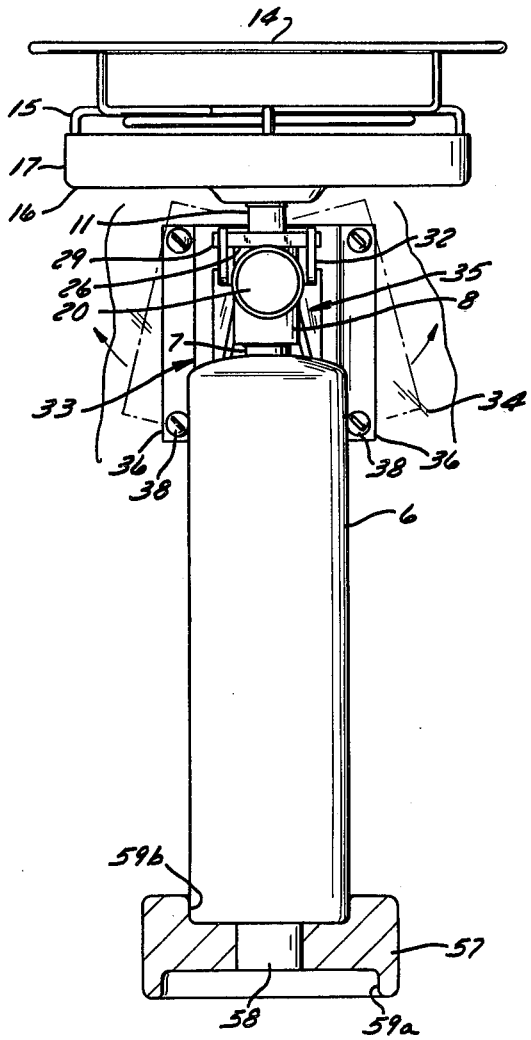
FIG. 8 is a front view of the gimbal-mounted stove connected with another form of pressure bottle.
Figure 6:
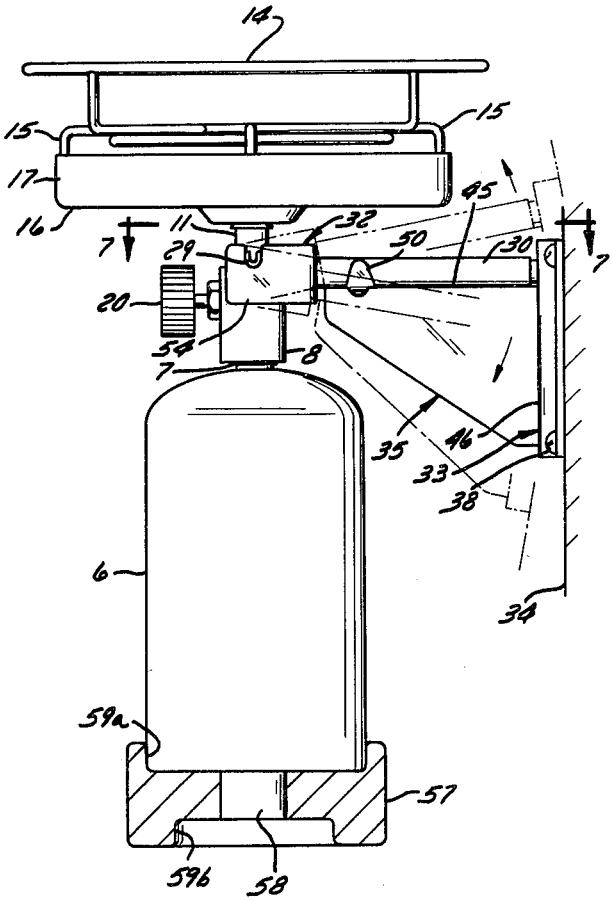
FIG. 6 is a side view of the assembled stove and its gimbal mounting.

Since the gimble axes about which the stove swings are below the level of the burner 13, it is important that the center of gravity of the swingable system be maintained well below the gimbal axes and that there be substantial mass below those axes to counterbalance the weight of any cooking vessel and its contents that may be resting on the grill 14. To that end a cylindrical weight 57, preferably a bronze casting, is securely but readily removably attached to the bottom portion of the fuel bottle 6 connected to the stove. Preferably a permanent magnet 58 is coaxially embedded in the weight 57. In one axial end of the weight 57 there is a coaxial larger diameter well **59*a* for closely receiving the lower end portion of a short, relatively large diameter pressure gas bottle such as is shown in FIGS. 1 and 6, while a smaller coaxial well 59*b* in its other end can closely receive the lower end of a narrower but higher bottle such as is shown in FIG. 8. The weight 57 as shown is thus cooperable with the two commonly available types of pressure gas bottles suitable for marine stoves, and it will be apparent that the magnet 58**, in extending coaxially through the weight, magnetically attaches the weight to the bottom of either type of bottle. It will be evident that the weight could be so formed as to be clampingly secured to the bottom portion of a pressure gas bottle.

From the foregoing description taken with the accompanying drawings it will be readily apparent that this invention provides a small gimbal mounted stove which is so arranged that a cooking vessel thereon is readily accessible. It will also be apparent that the gimbal mounting of this invention comprises only a few simple and inexpensive parts that can be quickly and easily disassembled for very compact stowage and just as readily assembled for use; that the part of the gimbal structure that is permanently secured to a bulkhead or similar structural member protrudes only negligibly from it; and that the assembled gimbal structure is very sturdy because it is arranged for good distribution of stresses.

What is claimed as the invention is:

1. Gimbal mounting means for a portable stove of the type that comprises a pressurized fuel container having an outlet nipple at an upper end thereof, a burner spaced above said nipple and coaxially connected therewith, and means for supporting a cooking vessel over said burner to be heated by a flame thereat, said gimbal mounting means providing for detachable connection of said stove to a structural member such as a boat bulkhead and enabling the stove to remain upright notwithstanding substantial tilting of the structural member, said mounting means being characterized by:

A. a shaft having a head on a rear end thereof;

B. a plate-like member securable to a structural member and having front and rear surfaces, and further having (1) a hole through which said head can pass for engagement against said rear surface and through which the shaft can project forwardly with its rear end confined against upward and sideward movement by edge portions that said hole defines, and (2) a plurality of vertically elongated hook receiving apertures;

C. a bracket cooperable with said plate-like member to support the shaft in rotatable forwardly projecting relation to said plate-like member, said bracket having (1) a top surface upon which the shaft rests, (2) a pair of opposing abutments projecting above said top surface and between which the shaft is closely receivable, and (3) a plurality of rearwardly and downwardly projecting hooks that are receivable in said apertures and engageable with said plate-like member to detachably connect the bracket thereto;

D. a pivot member having an aperture that provides for its coaxial securement to said nipple and having a pair of trunnions which are spaced to opposite sides of said aperture and are coaxial with one another; and E. a substantially U-shaped yoke on the front end of the shaft having forwardly projecting legs which are spaced laterally in opposite directions from the shaft axis and in each of which there is an upwardly opening transversely extending groove wherein one of said trunnions is receivable for supporting the stove to swing about the mutually perpendicular axes of said trunnions and of the shaft.

2. A small stove for detachable connection to a structural member such as a boat bulkhead that has an upright surface which may tilt substantially in any direction, said stove being of the type comprising a burner, connection means for communicating the burner with an outlet nipple at an upper end of a pressurized fuel container, and means for supporting a cooking vessel above the burner to be heated thereby, said stove being characterized by:

A. said connection means comprising a pair of coaxial elements, one of which has a portion that is threaded into the other, said elements having axially opposed circumferential shoulders surrounding said threaded portion;

B. a pivot member (1) having a flat body wherein there is a hole through which said threaded portion extends and which is confined between said shoulders, and (2) a pair of coaxial trunnions projecting from said body in opposite edgewise directions;

C. a shaft having at a front end thereof a substantially U-shaped yoke with forwardly projecting legs that can straddle said telescoping elements and in each of which there is an upwardly opening groove wherein one of said trunnions is receivable to connect said telescoping elements with the shaft for swinging about an axis transverse to that of the shaft; and D. mounting means supporting said shaft for rotation about its axis and with its axis substantially horizontal.

3. The stove of claim 2, further characterized by:

E. a weight detachably securable to a pressurized fuel container connected with said burner.

4. The stove of claim 3 wherein said weight comprises a magnet for magnetic attachment to the fuel container.

5. The stove of claim 2, further characterized by: said mounting means comprising (1) a plate having front and rear surfaces and having (a) a shaft receiving hole and (b) a plurality of vertically elongated hook apertures;

(2) attachment means for securing said plate to a structural member with said rear surface in forwardly spaced relation to an upright surface on the structural member;

(3) a head on the rear end of said shaft that is receivable through said hole in the plate and is engageable with said rear surface to releasably confine the shaft against axially forward movement; and (4) a bracket cooperable with edge portions of said plate that are defined by said hole therein to support the shaft in forwardly projecting rotatable relation to the plate, said bracket having (a) a top surface upon which the shaft rests, (b) opposing abutments projecting above said top surface and between which the shaft is closely receivable, and (c) a plurality of rearwardly and downwardly projecting hooks which are receivable in said apertures to detachably connect the bracket with the plate.

6. The stove of claim 5 wherein said attachment means comprises flanges integral with said plate that extend along a pair of opposite edges thereof and have rear surfaces which are in rearwardly offset relation to said rear surface of the plate.

* * * * *